US005779348A

United States Patent [19]

Interlicchio

[11] Patent Number: 5,779,348

[45] Date of Patent: Jul. 14, 1998

[54] ILLUMINATED SAFETY SHOULDER STRAP

[76] Inventor: Joseph C. Interlicchio, 283 Curtin Ave., West Islip, N.Y. 11795

[21] Appl. No.: 800,955

[22] Filed: Feb. 18, 1997

[51] Int. Cl.[6] ..... F21L 15/06

[52] U.S. Cl. ..... 362/108; 362/103

[58] Field of Search ..... 362/103, 108, 362/234, 240, 252, 238, 806, 249, 184

[56] References Cited

U.S. PATENT DOCUMENTS

| | | | |
|---|---|---|---|
| D. 273,818 | 5/1984 | Spencer | D2/27 |
| D. 280,860 | 10/1985 | Monferrato | D2/27 |
| D. 363,572 | 10/1995 | Obenchain | D30/145 |
| 3,153,745 | 10/1964 | Gurian et al. | 362/108 |
| 4,328,533 | 5/1982 | Paredes | 362/108 |
| 4,709,307 | 11/1987 | Branom | 362/103 |
| 4,839,777 | 6/1989 | Janko et al. | 362/108 |
| 5,070,436 | 12/1991 | Alexander et al. | 362/108 |
| 5,488,361 | 1/1996 | Perry | 340/984 |
| 5,630,382 | 5/1997 | Barbera et al. | 362/108 |

FOREIGN PATENT DOCUMENTS

| | | | |
|---|---|---|---|
| 2178838 | 2/1987 | United Kingdom | 362/108 |

*Primary Examiner*—Thomas M. Sember
*Attorney, Agent, or Firm*—Richard L. Miller, P.E.

[57] ABSTRACT

An illuminated safety shoulder strap that includes an elongated and slender waist belt, an elongated and slender shoulder strap, a plurality of light bulbs, and a generally semi-cylindrically-shaped power supply housing. The elongated and slender waist belt replaceably encircles the waist of the user when the illuminated safety shoulder strap is donned. The elongated and slender waist belt has a buckle end, a free end, an outer surface, and a right portion with a shape and extends along the right side of the waist of the user when the illuminated safety shoulder strap is donned. The right portion of the elongated and slender waist belt has a front and a back. The plurality of light bulbs extend longitudinally along, and outwardly from, the elongated and slender shoulder strap. The generally semi-cylindrically-shaped power supply housing is attached to the outer surface of the elongated and slender waist belt, at the front of the right portion of the elongated and slender waist belt. The generally semi-cylindrically-shaped power supply housing has a concave-shaped waist surface that conforms to the shape of the right portion of the elongated and slender waist belt when the illuminated safety shoulder strap is donned so as to provide greater comfort for the user. And, the generally semi-cylindrically-shaped power supply housing further has a convex-shaped outer surface that provides a smooth surface so as to prevent injury to the arm of the user and to any person coming in contact therewith.

15 Claims, 1 Drawing Sheet

FIG. 1
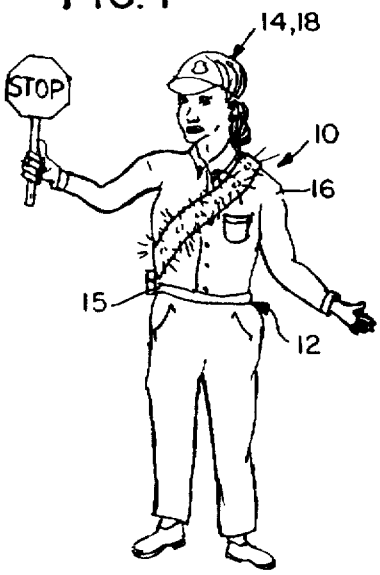
FIG. 4
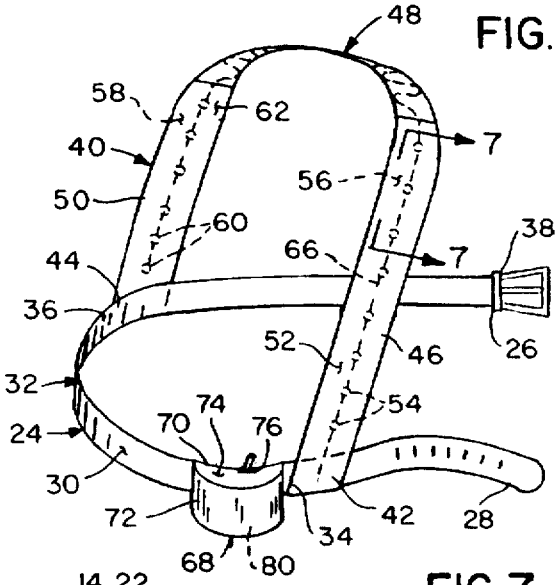
FIG. 2
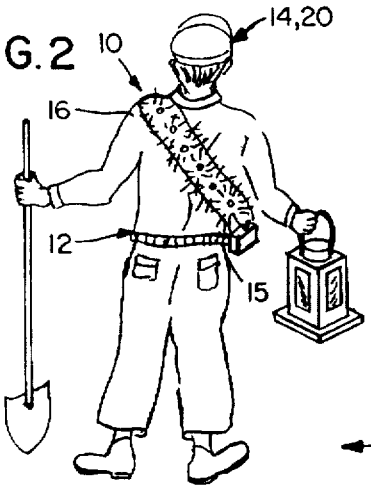
FIG. 3
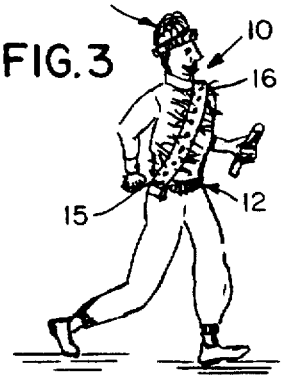
FIG. 7
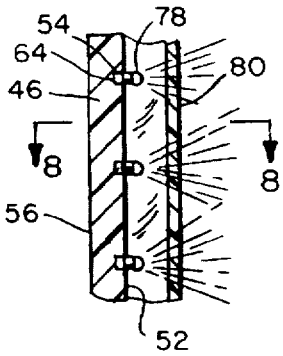
FIG. 6
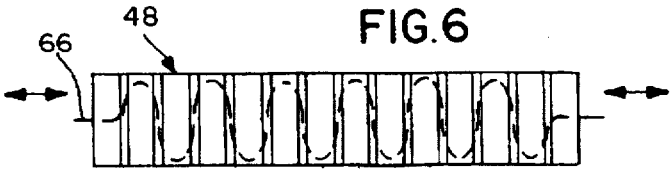
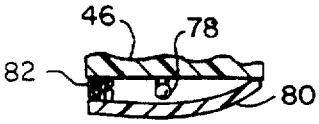
FIG. 8
FIG. 5
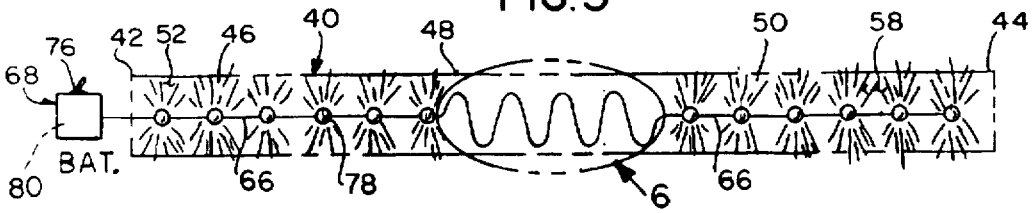

ILLUMINATED SAFETY SHOULDER STRAP

BACKGROUND OF THE INVENTION

1. Field of the Invention

The present invention relates to an illuminated garment. More particularly, the present invention relates to art illuminated safety shoulder strap that includes an elongated and slender waist belt, an elongated and slender shoulder strap, a plurality of light bulbs, and a generally semi-cylindrically-shaped power supply housing.

2. Description of the Prior Art

Numerous innovations for illuminated garments have been provided in the prior art that will be described. Even though these innovations may be suitable for the specific individual purposes to which they address, however, they differ from the present invention in that they do not teach an illuminated safety shoulder strap that includes an elongated and slender waist belt, an elongated and slender shoulder strap, a plurality of light bulbs, and a generally semi-cylindrically-shaped power supply housing.

FOR EXAMPLE, U.S. Pat. No. Des. 273,818 to Spencer teaches the ornamental design for a safety vest for runner.

ANOTHER EXAMPLE, U.S. Pat. No. Des. 280,860 to Monferrato teaches the ornamental design for a reflective safety vest.

STILL ANOTHER EXAMPLE, U.S. Pat. No. Des. 363,572 to Obenchain teaches the ornamental design for a reflective pet vest.

YET ANOTHER EXAMPLE, U.S. Pat. No. 4,328,533 to Paredes teaches an illuminated safety harness for wearing with or without a vest. The harness has a battery compartment in its belt connected through a switch to lamp sockets fixed on each shoulder. Each lamp socket is designed for a flashing light bulb. The harness has a plurality of reflective, luminescent, or phosphorescent patches on its front and back to increase the visibility of the wearer during conditions of poor visibility. The elements of the electrical system are held in the harness which is fitted with snaps so it may be fastened to a vest, or to straps which fasten it directly about a user. The vest is preferably reversible with one side of a white reflective material for night use and the opposed side of a brightly colored material for daytime use.

STILL YET ANOTHER EXAMPLE, U.S. Pat. No. 4,709,307 to Branom teaches an article of clothing. The article includes a shell forming an outer layer of the article, a liner disposed generally inside the shell and forming an inner layer of the article, and a set of light-emitting diodes or the like forming a predetermined pattern on the exterior of the article of clothing. The set of light-emitting diodes is mounted on a substrate. A power source is provided for illuminating the diodes, and a control circuit controls the energization of the diodes. There is a pocket in the article of clothing in which the power source is removably disposed. A cable electrically connects the diodes and the power source. The cable is disposed generally between the shell and the liner so as to be hidden from view and protected. An overlay has imprinted thereon a pattern corresponding to the predetermined pattern of the diodes. The overlay has openings therethrough through which the diodes extend, and the overlay is secured to the shell.

YET STILL ANOTHER EXAMPLE, U.S. Pat. No. 5,070,436 to Alexander et al. teaches a signal vest to protect people who must be seen, to avoid their injury, when they are in areas where safety protection is needed, such as on or nearby roadways, highways, waterways, airports, etc. The signal vest is made of durable bright colored materials, durable reflective materials, and is equipped in front and back with flashing lights, controlled by self contained electrical circuits, including a replaceable and/or rechargeable battery. The electrical circuits operate independently of one another, so any damage to one circuit, only eliminates some of the front and back flashing lights.

STILL YET ANOTHER EXAMPLE, U.S. Pat. No. 5,448,361 to Perry teaches a navigation lights device that comprises red, green, and white navigation lights attached to the top of a left shoulder portion, a right shoulder portion, and a back side portion, respectively, of a buoyant vest or harness worn over the upper body of a person. A battery pack can be attached to the vest to provide electrical power to the navigation lights via wires that extend therebetween. The navigation lights device can be permanently attached to the vest or can be releasibly attached. The navigation lights device also comprises headgear or a helmet that is worn over a top portion of a person's head and includes red, green, and white navigation lights attached to a left side portion, right side portion, and back side portion, respectively, of the headgear. The headgear can include a battery pack attached to the headgear to provide electrical power to the navigation lights via wires that extend therebetween.

It is apparent that numerous innovations for illuminated garments have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an illuminated safety shoulder strap that avoids the disadvantages of the prior art.

ANOTHER OBJECT of the present invention is to provide an illuminated safety shoulder strap that is simple and inexpensive to manufacture.

STILL ANOTHER OBJECT of the present invention is to provide an illuminated safety shoulder strap that is simple to use.

YET ANOTHER OBJECT of the present invention is to provide an illuminated safety shoulder strap that is similar in configuration to a crossing guard's belt.

STILL YET ANOTHER OBJECT of the present invention is to provide an illuminated safety shoulder strap that is adjustable to fit children in small, medium, and large sizes.

YET STILL ANOTHER OBJECT of the present invention is to provide an illuminated safety shoulder strap that is adjustable to fit adults in small, medium, and large sizes.

STILL YET ANOTHER OBJECT of the present invention is to provide an illuminated safety shoulder strap that is a safety feature for joggers, skaters, cyclists for use after twilight so that they can be seen by motorists.

YET STILL ANOTHER OBJECT of the present invention is to provide an illuminated safety shoulder strap that can be used by crossing guards while on duty anytime of the day.

STILL YET ANOTHER OBJECT of the present invention is to provide an illuminated safety shoulder strap that can be used by police officers or anyone directing traffic.

YET STILL ANOTHER OBJECT of the present invention is to provide an illuminated safety shoulder strap that can be used by railroad workers to increase their visibility.

STILL YET ANOTHER OBJECT of the present invention is to provide an illuminated safety shoulder strap that can be used by emergency personnel responding to traffic accidents, especially on busy highways.

YET STILL ANOTHER OBJECT of the present invention is to provide an illuminated safety shoulder strap that is wearable by a user having an arm, a waist with a right side, a chest, a left shoulder, and a back.

BRIEFLY STATED, STILL YET ANOTHER OBJECT of the present invention is to provide an illuminated safety shoulder strap that includes an elongated and slender waist belt, an elongated and slender shoulder strap, a plurality of light bulbs, and a generally semi-cylindrically-shaped power supply housing.

YET STILL ANOTHER OBJECT of the present invention is to provide an illuminated safety shoulder strap wherein the elongated and slender waist belt replaceably encircles the waist of the user when the illuminated safety shoulder strap is donned.

STILL YET ANOTHER OBJECT of the present invention is to provide an illuminated safety shoulder strap wherein the elongated and slender waist belt has a buckle end, a free end, an outer surface, and a right portion with a shape and extends along the right side of the waist of the user when the illuminated safety shoulder strap is donned.

YET STILL ANOTHER OBJECT of the present invention is to provide an illuminated safety shoulder strap wherein the right portion of the elongated and slender waist belt has a front and a back.

STILL YET ANOTHER OBJECT of the present invention is to provide an illuminated safety shoulder strap wherein the elongated and slender shoulder strap has a front end and a back end.

YET STILL ANOTHER OBJECT of the present invention is to provide an illuminated safety shoulder strap wherein the front end of the elongated and slender shoulder strap is attached to the outer surface of the elongated and slender waist belt, at the front of the right portion of the elongated and slender waist belt, and extends diagonally upwardly therefrom, along the chest of the user, over the left shoulder of the user, and diagonally downwardly along the back of the user to the back of the right portion of the elongated and slender waist belt where it is attached to the outer surface thereof.

STILL YET ANOTHER OBJECT of the present invention is to provide an illuminated safety shoulder strap wherein the plurality of light bulbs extend longitudinally along, and outwardly from, the elongated and slender shoulder strap.

YET STILL ANOTHER OBJECT of the present invention is to provide an illuminated safety shoulder strap wherein the generally semi-cylindrically-shaped power supply housing is attached to the outer surface of the elongated and slender waist belt, at the front of the right portion of the elongated and slender waist belt.

STILL YET ANOTHER OBJECT of the present invention is to provide an illuminated safety shoulder strap wherein the generally semi-cylindrically-shaped power supply housing has a concave-shaped waist surface that conforms to the shape of the right portion of the elongated and slender waist belt when the illuminated safety shoulder strap is donned so as to provide greater comfort for the user.

YET STILL ANOTHER OBJECT of the present invention is to provide an illuminated safety shoulder strap wherein the generally semi-cylindrically-shaped power supply housing further has a convex-shaped outer surface that provides a smooth surface so as to prevent injury to the arm of the user and to any person coming in contact therewith.

STILL YET ANOTHER OBJECT of the present invention is to provide an illuminated safety shoulder strap that further includes a buckle disposed at the buckle end of the elongated and slender waist belt, and releasibly and maintainably receives the free end of the elongated and slender waist belt so as to allow the elongated and slender waist belt to be replaceably maintained around the waist of the user.

YET STILL ANOTHER OBJECT of the present invention is to provide an illuminated safety shoulder strap wherein the elongated and slender shoulder strap includes a front portion that extends diagonally along the chest of the user when the illuminated safety shoulder strap is donned, an elastic shoulder portion that extends along the left shoulder of the user when the illuminated safety shoulder strap is donned and expands and contracts to accommodate different sized users, and a back portion that extends diagonally along the back of the user when the illuminated safety shoulder strap is donned.

STILL YET ANOTHER OBJECT of the present invention is to provide an illuminated safety shoulder strap wherein the front portion of the elongated and slender shoulder strap has an outer surface with a plurality of longitudinally and equally spaced-apart apertures therein, and an inner surface.

YET STILL ANOTHER OBJECT of the present invention is to provide an illuminated safety shoulder strap wherein the back portion of the elongated and slender shoulder strap has an outer surface with a plurality of longitudinally and equally spaced-apart apertures therein, and an inner surface.

STILL YET ANOTHER OBJECT of the present invention is to provide an illuminated safety shoulder strap that further includes a plurality of light sockets disposed in the plurality of longitudinally and equally spaced-apart apertures in the outer surface of the front portion of the elongated and slender shoulder strap and in the plurality of longitudinally and equally spaced-apart apertures in the outer surface of the back portion of the elongated and slender shoulder strap, and replaceably receive the plurality of light bulbs.

YET STILL ANOTHER OBJECT of the present invention is to provide an illuminated safety shoulder strap wherein the plurality of light sockets are in electrical communication with each other by wires.

STILL YET ANOTHER OBJECT of the present invention is to provide an illuminated safety shoulder strap wherein the wires are hemmed and sewn longitudinally in the inner surface of the front portion of the elongated and slender shoulder strap, are hemmed and sewn longitudinally in the inner surface of the back portion of the elongated and slender shoulder strap, and pass serpentinally through the elastic shoulder portion of the elongated and slender shoulder strap so as to allow the shoulder portion of the elongated and slender shoulder strap to expand and contract without damaging the wires therein.

YET STILL ANOTHER OBJECT of the present invention is to provide an illuminated safety shoulder strap wherein the generally semi-cylindrically-shaped power supply housing further has a generally semi-circular-shaped upper surface in which a switch extends upwardly from that is in electrical communication with the wires.

STILL YET ANOTHER OBJECT of the present invention is to provide an illuminated safety shoulder strap wherein the plurality of light bulbs are one of multi-colored and incandescent.

YET STILL ANOTHER OBJECT of the present invention is to provide an illuminated safety shoulder strap that further includes a power supply disposed in the generally semi-cylindrically-shaped power supply housing, and in electrical communication with the wires and the switch.

STILL YET ANOTHER OBJECT of the present invention is to provide an illuminated safety shoulder strap wherein the power supply is one of four "D" cell rechargeable batteries and a rechargeable replacement battery unit.

YET STILL ANOTHER OBJECT of the present invention is to provide an illuminated safety shoulder strap that further includes a pair of clear, elongated, and slender cover sheet, each of which conforms to, and releasibly covers, the outer surface of the front portion of the elongated and slender shoulder strap and the outer surface of the back portion of the elongated and slender shoulder strap, and provides protection for the plurality of light bulbs.

FINALLY, STILL YET ANOTHER OBJECT of the present invention is to provide an illuminated safety shoulder strap wherein at least one longitudinal edge of each sheet of the pair of clear, elongated, and slender cover sheets is releasibly maintained to corresponding longitudinal edges of the outer surface of the front portion of the elongated and slender shoulder strap and the outer surface of the back portion of the elongated and slender shoulder strap, by hook and loop fasteners disposed at the longitudinal edges thereof so as to allow access to the plurality of light bulbs when replacement thereof is required.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic front perspective view of the present invention being worn by a crossing guard;

FIG. 2 is a diagrammatic rear perspective view of the present invention being worn by a construction worker;

FIG. 3 is a diagrammatic side perspective view of the present invention being worn by a jogger;

FIG. 4 is an enlarged diagrammatic perspective view of the present invention;

FIG. 5 is an enlarged diagrammatic top plan view of the shoulder strap of the present invention;

FIG. 6 is an enlarged diagrammatic top plan view of the area enclosed by the dotted ellipse identified by arrow 6 in FIG. 5;

FIG. 7 is a fragmented cross section view take along line 7—7 in FIG. 4 of an alternate embodiment of the present invention; and FIG. 8 is an enlarged cross sectional view taken along line 8—8 in FIG. 7.

LIST OF REFERENCE NUMERALS UTILIZED IN THE DRAWING

10 illuminated safety shoulder strap of the present invention
12 user waist
14 user
15 user waist right portion
16 user shoulder
18 crossing guard
20 construction worker
22 jogger
24 elongated and slender waist belt
26 waist belt buckle end
28 waist belt free end
30 waist belt outer surface
32 waist belt right waist portion
34 waist belt right waist portion front
36 waist belt right waist portion back
38 waist belt buckle end buckle
40 elongated and slender shoulder strap
42 shoulder strap front end
44 shoulder strap back end
46 shoulder strap front portion
48 shoulder strap elastic shoulder portion
50 shoulder strap back portion
52 shoulder strap front portion outer surface
54 shoulder strap front portion outer surface plurality of longitudinally and equally spaced-apart apertures
56 shoulder strap front portion inner surface
58 shoulder strap back portion outer surface
60 shoulder strap back portion outer surface plurality of longitudinally and equally spaced-apart apertures
62 shoulder strap back portion inner surface
64 plurality of light sockets
66 wires
68 generally semi-cylindrically-shaped power supply housing
70 power supply housing concave-shaped waist surface
72 power supply housing convex-shaped outer surface
74 power supply housing generally semi-circular-shaped upper surface
76 switch
78 plurality of light bulbs
79 power supply
80 pair of clear, elongated, and slender cover sheets
82 hook and loop fasteners

DETAILED DESCRIPTION OF THE PREFERRED EMBODIMENT

Referring now to the figures in which like numerals indicate like parts and particularly to FIGS. 1–3, which are a diagrammatic front perspective view of the present invention being worn by a crossing guard, a diagrammatic rear perspective view of the present invention being worn by a construction worker, and a diagrammatic side perspective view of the present invention being worn by a jogger, respectively, the illuminated safety shoulder strap of the present invention is shown generally at 10 being worn around a user waist 12 of a user 14 having a user waist right portion 15, and over a user shoulder 16 of the user 14 wherein the user 14 is shown to be a crossing guard 18, a construction worker 20, or a jogger 22, respectively.

The configuration of the illuminated safety shoulder strap can best be seen in FIGS. 4–6, which are an enlarged diagrammatic perspective view of the present invention, an enlarged diagrammatic top plan view of the shoulder strap of the present invention, and an enlarged diagrammatic top plan view of the area enclosed by the dotted ellipse identified by arrow 6 in FIG. 5, and as such will be discussed with reference thereto.

The illuminated safety shoulder strap 10 includes an elongated and slender waist belt 24 that replaceably encircles the user waist 12 of the user 14 when the illuminated safety shoulder strap 10 is donned, and has a waist belt buckle end 26, a waist belt free end 28, a waist belt outer surface 30, and a waist belt right waist portion 32 that extends along the user waist right portion 15 of the user waist 12 of the user 14 when the illuminated safety shoulder strap 10 is donned. The waist belt right waist portion 32 of the elongated and slender waist belt 24 has a waist belt right waist portion front 34 and a waist belt right waist portion back 36.

The illuminated safety shoulder strap 10 further includes a waist belt buckle end buckle 38 that is disposed at the waist belt buckle end 26 of the elongated and slender waist belt 24, and releasibly and maintainably receives the waist belt free end 28 of the elongated and slender waist belt 24 so as to allow the elongated and slender waist belt 24 to be replaceably maintained around the user waist 12 of the user 14.

The illuminated safety shoulder strap 10 further includes an elongated and slender shoulder strap 40 that has a shoulder strap front end 42 and a shoulder strap back end 44.

The shoulder strap front end 42 of the elongated and slender shoulder strap 40 is attached to the waist belt outer surface 30 of the elongated and slender waist belt 24, at the waist belt right waist portion front 34 of the waist belt right waist portion 32 of the elongated and slender waist belt 24, and extends diagonally upwardly therefrom, across the chest of the user, over the left shoulder of the user, diagonally downwardly along the back of the user, to the waist belt right waist portion back 36 of the waist belt right waist portion 32 of the elongated and slender waist belt 24 where it is attached to the waist belt outer surface 30 of the elongated and slender waist belt 24.

The elongated and slender shoulder strap 40 includes a shoulder strap front portion 46 that extends along the chest of the user when the illuminated safety shoulder strap 10 is donned, a shoulder strap elastic shoulder portion 48 that extends along the left shoulder of the user when the illuminated safety shoulder strap 10 is donned and expands and contracts to accommodate different sized users, and a shoulder strap back portion 50 that extends along the back of the user when the illuminated safety shoulder strap 10 is donned.

The shoulder strap front portion 46 of the elongated and slender shoulder strap 40 has a shoulder strap front portion outer surface 52 with a shoulder strap front portion outer surface plurality of longitudinally and equally spaced-apart apertures 54 therein, and a shoulder strap front portion inner surface 56.

The shoulder strap back portion 50 of the elongated and slender shoulder strap 40 has a shoulder strap back portion outer surface 58 with a shoulder strap back portion outer surface plurality of longitudinally and equally spaced-apart apertures 60 therein, and a shoulder strap back portion inner surface 62.

The illuminated safety shoulder strap 10 further includes a plurality of light sockets 64 that are disposed in the shoulder strap front portion outer surface plurality of longitudinally and equally spaced-apart apertures 54 in the shoulder strap front portion outer surface 52 of the shoulder strap front portion 46 of the elongated and slender shoulder strap 40 and in the shoulder strap back portion outer surface plurality of longitudinally and equally spaced-apart apertures 60 in the shoulder strap back portion outer surface 58 of the shoulder strap back portion 50 of the elongated and slender shoulder strap 40.

The plurality of light sockets 64 are in electrical communication with each other by wires 66 that are hemmed and sewn longitudinally in the shoulder strap front portion inner surface 56 of the shoulder strap front portion 46 of the elongated and slender shoulder strap 40, are hemmed and sewn longitudinally in the shoulder strap back portion inner surface 62 of the shoulder strap back portion 50 of the elongated and slender shoulder strap 40, and pass serpentinally through the shoulder strap elastic shoulder portion 48 of the elongated and slender shoulder strap 40 so as to allow the shoulder strap elastic shoulder portion 48 of the elongated and slender shoulder strap 40 to expand and contract without damaging the wires 66 therein.

The illuminated safety shoulder strap 10 further includes a generally semi-cylindrically-shaped power supply housing 68 that is attached to the waist belt outer surface 30 of the elongated and slender waist belt 24, at the waist belt right waist portion front 34 of the waist belt right waist portion 32 of the elongated and slender waist belt 24.

The generally semi-cylindrically-shaped power supply housing 68 has a power supply housing concave-shaped waist surface 70 that conforms to the shape of the waist belt right waist portion 32 of the elongated and slender waist belt 24 when the illuminated safety shoulder strap 10 is donned so as to provide greater comfort for the user 14.

The generally semi-cylindrically-shaped power supply housing 68 further has a power supply housing convex-shaped outer surface 72 that provides a smooth surface so as to prevent injury to the arm of the user 14 or to any other person coming in contact therewith.

The generally semi-cylindrically-shaped power supply housing 68 further has a power supply housing generally semi-circular-shaped upper surface 74 in which a switch 76 extends upwardly therefrom that is in electrical communication with the wires 66.

The illuminated safety shoulder strap 10 further includes a plurality of light bulbs 78 that are removably received in the plurality of light sockets 64, and are preferably multi-colored or incandescent.

The illuminated safety shoulder strap 10 further includes a power supply 79 that is disposed in the generally semi-cylindrically-shaped power supply housing 68, and is in electrical communication with the wires 66 and the switch 76, and is preferably four "D" cell rechargeable batteries, or can be rechargeable replacement battery unit.

An alternate embodiment of the illuminated safety shoulder strap 10 can best be seen in FIGS. 7 and 8, which are fragmented cross section view take along line 7—7 in FIG. 4 of an alternate embodiment of the present invention, and an enlarged cross sectional view taken along line 8—8 in FIG. 7, respectively, and as such will be discussed with reference thereto.

The alternate embodiment of the illuminated safety shoulder strap 10 is similar to that discussed, supra, but with an additional element.

The additional element is a pair of clear, elongated, and slender cover sheets 80, each of which conforms to, and releasibly covers, the shoulder strap front portion outer surface 52 of the shoulder strap front portion 46 of the elongated and slender shoulder strap 40 and the shoulder strap back portion outer surface 58 of the shoulder strap back portion 50 of the elongated and slender shoulder strap 40, and provides protection for the plurality of light bulbs 78.

At least one longitudinal edge of each sheet of the pair of clear, elongated, and slender cover sheets 80 is releasibly maintained to the corresponding longitudinal edges of the shoulder strap front portion outer surface 52 of the shoulder strap front portion 46 of the elongated and slender shoulder strap 40 and the shoulder strap back portion outer surface 58 of the shoulder strap back portion 50 of the elongated and slender shoulder strap 40, by hook and loop fasteners 82 disposed at the longitudinal edges thereof so as to allow access to the plurality of light bulbs 78 when replacement thereof is required.

It will be understood that each of the elements described above, or two or more together, may also find a useful application in other types of constructions differing from the types described above.

While the invention has been illustrated and described as embodied in a illuminated safety shoulder strap, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An illuminated safety shoulder strap that is wearable by a user having an arm, a waist with a right side, a chest, a left shoulder, and a back, said strap comprising:

a) an elongated and slender waist belt replaceably encircling the waist of the user when said illuminated safety shoulder strap is donned; said elongated and slender waist belt having a buckle end, a free end, an outer surface, and a right portion with a shape and extending along the right side of the waist of the user when said illuminated safety shoulder strap is donned; said right portion of said elongated and slender waist belt having a front and a back;

b) said shoulder strap being elongated and slender and having a front end and a back end; said front end of said elongated and slender shoulder strap being attached to said outer surface of said elongated and slender waist belt, at said front of said right portion of said elongated and slender waist belt, and extending diagonally upwardly therefrom, along the chest of the user, over the left shoulder of the user, and diagonally downwardly along the back of the user to said back of said right portion of said elongated and slender waist belt where it is attached to said outer surface thereof;

c) a plurality of light bulbs extending longitudinally along, and outwardly from, said elongated and slender shoulder strap; and d) a generally semi-cylindrically-shaped power supply housing attached to said outer surface of said elongated and slender waist belt, at said front of said right portion of said elongated and slender waist belt; said generally semi-cylindrically-shaped power supply housing having a concave-shaped waist surface conforming to said shape of said right portion of said elongated and slender waist belt when said illuminated safety shoulder strap is donned so as to provide greater comfort for the user; said generally semi-cylindrically-shaped power supply housing further having a convex-shaped outer surface providing a smooth surface so as to prevent injury to the arm of the user and to any person coming in contact therewith.

2. The strap as defined in claim 1; further comprising a buckle disposed at said buckle end of said elongated and slender waist belt, and releasibly and maintainably receiving said free end of said elongated and slender waist belt so as to allow said elongated and slender waist belt to be replaceably maintained around the waist of the user.

3. The strap as defined in claim 1, wherein said elongated and slender shoulder strap includes a front portion that extends diagonally along the chest of the user when said illuminated safety shoulder strap is donned, an elastic shoulder portion that extends along the left shoulder of the user when said illuminated safety shoulder strap is donned and expands and contracts to accommodate different sized users, and a back portion that extends diagonally along the back of the user when said illuminated safety shoulder strap is donned.

4. The strap as defined in claim 3, wherein said front portion of said elongated and slender shoulder strap has an outer surface with a plurality of longitudinally and equally spaced-apart apertures therein, and an inner surface.

5. The strap as defined in claim 4, wherein said back portion of said elongated and slender shoulder strap has an outer surface with a plurality of longitudinally and equally spaced-apart apertures therein, and an inner surface.

6. The strap as defined in claim 5; further comprising a plurality of light sockets disposed in said plurality of longitudinally and equally spaced-apart apertures in sail outer surface of said front portion of said elongated and slender shoulder strap and in said plurality of longitudinally and equally spaced-apart apertures in said outer surface of said back portion of said elongated and slender shoulder strap, and replaceably receiving said plurality of light bulbs.

7. The strap as defined in claim 6, wherein said plurality of light sockets are in electrical communication with each other by wires.

8. The strap as defined in claim 7, wherein said wires are hemmed and sewn longitudinally in said inner surface of said front portion of said elongated and slender shoulder strap, are hemmed and sewn longitudinally in said inner surface of said back portion of said elongated and slender shoulder strap, and pass serpentinally through said elastic shoulder portion of said elongated and slender shoulder strap so as to allow said shoulder portion of said elongated and slender shoulder strap to expand and contract without damaging said wires therein.

9. The strap as defined in claim 7, wherein said generally semi-cylindrically-shaped power supply housing further has a generally semi-circular-shaped upper surface in which a switch extends upwardly from that is in electrical communication with said wires.

10. The strap as defined in claim 1, wherein said plurality of light bulbs are one of multi-colored and incandescent.

11. The strap as defined in claim 9; further comprising a power supply disposed in said generally semi-cylindrically-shaped power supply housing, and in electrical communication with said wires and said switch.

12. The strap as defined in claim 11, wherein said power supply is one of four "D" cell rechargeable batteries and a rechargeable replacement battery unit.

13. The strap as defined in claim 3; further comprising a pair of clear, elongated, and slender cover sheet, each of which conforming to, and releasibly covering, said outer surface of said front portion of said elongated and slender shoulder strap and said outer surface of said back portion of said elongated and slender shoulder strap, and providing protection for said plurality of light bulbs.

14. The strap as defined in claim 13, wherein at least one longitudinal edge of each sheet of said pair of clear, elongated, and slender cover sheets is releasibly maintained to corresponding longitudinal edges of said outer surface of said front portion of said elongated and slender shoulder strap and said outer surface of said back portion of said elongated and slender shoulder strap, by hook and loop fasteners disposed at said longitudinal edges thereof so as to allow access to said plurality of light bulbs when replacement thereof is required.

15. A method of illuminating a user having a chest, a left shoulder, a back, and a waist with a right side, comprising the step of donning on the user an illuminated safety shoulder strap which comprises:

a) an elongated and slender waist belt replaceable encircling the waist of the user when said illuminated safety shoulder strap is donned; said elongated and slender waist belt having a buckle end, a free end, an outer surface, and a right portion with a shape and extending along the right side of the waist of the user when said illuminated safety shoulder strap is donned; said right portion of said elongated and slender waist belt having a front and a back;

b) said shoulder strap being elongated and slender strap and having a front end and a back end; said front end of said elongated and slender shoulder strap being attached to said outer surface of said elongated and slender waist belt, at said front of said right portion of said elongated and slender waist belt, and extending diagonally upwardly therefrom, along the chest of the user, over the left shoulder of the user, and diagonally downwardly along the back of the user to said back of said right portion of said elongated and slender waist belt where it is attached to said outer surface thereof;

c) a plurality of light bulbs extending longitudinally along, and outwardly from, said elongated and slender shoulder strap; and d) a generally semi-cylindrically-shaped power supply housing attached to said outer surface of said elongated and slender waist belt, at said front of said right portion of said elongated and slender waist belt; said generally semi-cylindrically-shaped power supply housing having a concave-shaped waist surface conforming to said shape of said right portion of said elongated and slender waist belt when said illuminated safety shoulder strap is donned so as to provide greater comfort for the user; said generally semi-cylindrically-shaped power supply housing further having a convex-shaped outer surface providing a smooth surface so as to prevent injury to the arm of the user and to any person coming in contact therewith.

* * * * *